US005731798A

United States Patent [19]

Shin

[11] Patent Number: 5,731,798

[45] Date of Patent: Mar. 24, 1998

[54] CIRCUIT FOR OUTPUTTING A LIQUID CRYSTAL DISPLAY-CONTROLLING SIGNAL IN INPUTTING DATA ENABLE SIGNAL

[75] Inventor: Hyeog-Sang Shin, Kyungki-do, Rep. of Korea

[73] Assignee: Samsung Electronics Co., Ltd., Suwon, Rep. of Korea

[21] Appl. No.: 519,613

[22] Filed: Aug. 25, 1995

[30] Foreign Application Priority Data

Aug. 26, 1994 [KR] Rep. of Korea ..... 94-21197

[51] Int. Cl.[6] ..... G09G 3/36

[52] U.S. Cl. ..... 345/99; 345/213

[58] Field of Search ..... 345/3, 213, 212, 345/211, 99, 87, 98, 112, 132; 348/790, 791, 792, 793; H04N 3/14, 9/30

[56] References Cited

U.S. PATENT DOCUMENTS 4,486,779 12/1984 Marti ..... 345/213

4,839,638 6/1989 Kosler et al. ..... 345/213

5,159,327 10/1992 Yi ..... 345/213

5,329,288 7/1994 Kim ..... 345/213

*Primary Examiner*—Xiao Wu

*Attorney, Agent, or Firm*—Cushman Darby & Cushman IP Group of Pillsbury Madison & Sutro LLP

[57] ABSTRACT

A circuit for outputting a liquid crystal display controlling signal in inputting a data enable signal. A circuit for controlling an LCD drive integrated circuit by a horizontal synchronous signal and a circuit for controlling the LCD drive IC by the data enable signal are separately designed in a conventional circuit for outputting the LCD-controlling signal. However, conventionally, the number of both pins and gates of the application specific integrated circuit which makes up the conventional circuit are increased. The present circuit uses data enable and HSYNC signals through one pin, makes the HSYNC signal by using the data enable signal, and instead of a circuit for controlling the LCD drive IC by the data enable signal, it uses a circuit for controlling the LCD drive IC by the HSYNC signal, thereby reducing the number of gates and optimizing the circuit.

7 Claims, 3 Drawing Sheets

CIRCUIT FOR OUTPUTTING A LIQUID CRYSTAL DISPLAY-CONTROLLING SIGNAL IN INPUTTING DATA ENABLE SIGNAL

BACKGROUND OF THE INVENTION (1) Field of the Invention

The present invention relates to a circuit for outputting a liquid crystal display (hereinafter referred to as LCD)-controlling signal in inputting data enable (hereinafter referred to as DE) signal.

(2) Description of the Prior Art

A circuit for controlling an LCD drive integrated circuit (hereinafter referred to as IC) by a horizontal synchronous (hereinafter referred to as HSYNC) signal and a circuit for controlling an LCD drive IC by a DE signal are separately designed in a conventional circuit for outputting an LCD-controlling signal. However, conventionally, the number of both pins and gates of an application specific integrated circuit (hereinafter referred to as ASIC) which comprises the conventional circuit are increased.

SUMMARY OF THE INVENTION

An object of the present invention is to provide a circuit for outputting an LCD controlling signal while inputting a DE signal that is capable of solving the problem in the prior art. This invention receives the DE and HSYNC signals through one pin, makes the HSYNC signal by using the DE signal, and instead of a circuit for controlling the LCD drive IC by the DE signal, it uses a circuit for controlling the LCD drive IC by the HSYNC signal, thereby reducing the number of gates and optimizing the circuit.

In order to achieve this object, the present invention comprises a DE signal controller for outputting a HSYNC signal after receiving a DE signal, a multiplexer for selecting and outputting one of an original HSYNC signal and the HSYNC signal outputted from the DE signal controller after receiving the above-identified two HSYNC signals, and a LCD controller for controlling an LCD drive IC and outputting a LCD controlling signal by using the HSYNC signal selected by the multiplexer.

DETAILED DESCRIPTION OF A PREFERRED EMBODIMENT

A preferred embodiment of the present invention will become apparent from a study of the following detailed description, when viewed in light of the accompanying drawings.

Figure 1:
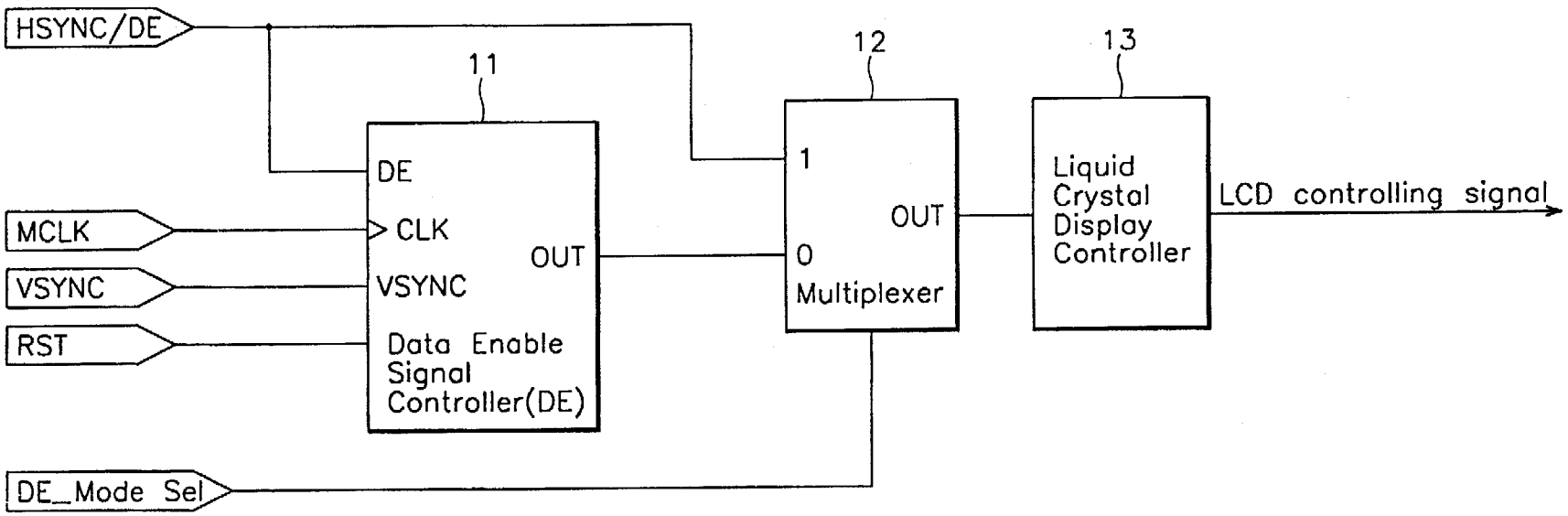
FIG. 1 is a block diagram of a circuit for outputting an LCD controlling signal in inputting a DE signal in accordance with a preferred embodiment of the present invention.

As shown in FIG. 1, a circuit for outputting an LCD controlling signal while inputting a DE signal in accordance with a preferred embodiment of the present invention comprises: a DE signal controller 11 for receiving a main clock (hereinafter referred to as MCLK) signal inputted to a clock terminal, a vertical synchronous (hereinafter referred to as VSYNC) signal, a reset signal RST, and a DE signal as input signals; a multiplexer 12 for selecting and outputting one of an original HSYNC signal and another HSYNC signal outputted from the DE signal controller 11 by using a DE_Mode SEL signal after receiving the above-identified two HSYNC signals; and an LCD controller 13 for outputting an LCD controlling signal after receiving a signal outputted from the multiplexer 12.

Figure 2:
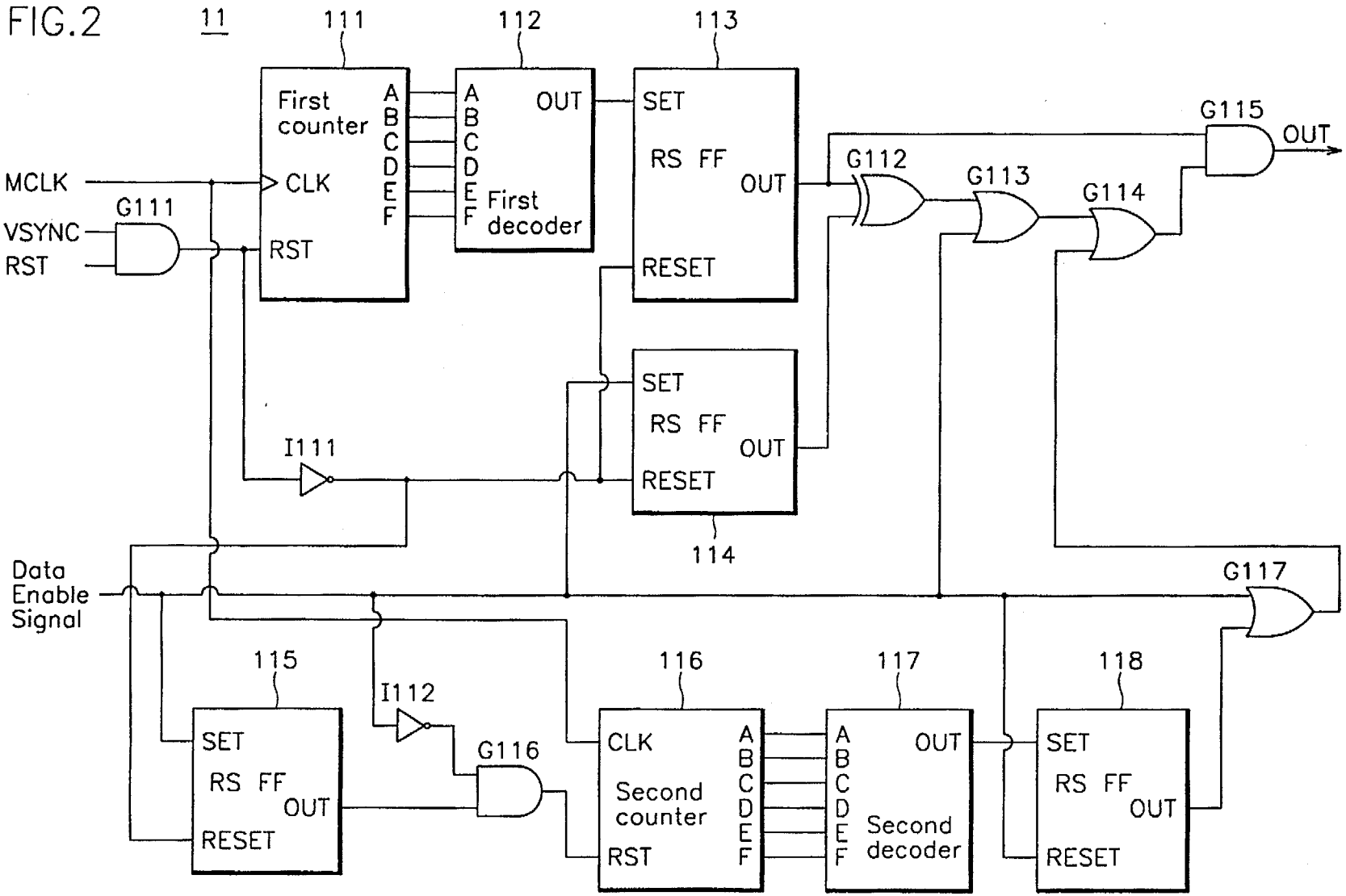
FIG. 2 is a detailed circuit diagram of a DE signal controller of a circuit for outputting the LCD controlling signal in inputting the DE signal in accordance with a preferred embodiment of the present invention.

As shown in FIG. 2, the DE signal controller of the circuit for outputting an LCD controlling signal in inputting an DE signal in accordance with a preferred embodiment of the present invention comprises: an AND gate G111 for receiving the VSYNC and RST signals; a first counter 111 for receiving the MCLK signal as input of a clock terminal CLK and receiving the output signal of the gate G111 as the input of an RST terminal; a first decoder 112 for receiving the output signals A,B,C,D,E, and F of the first counter 111 as input signals; a first inverter I111 for receiving the output of the gate G111; a first RS flip-flop 115 for receiving the DE signal as the input of a SET terminal and receiving the output of the inverter I111 as the input of a RESET terminal; a second inverter I112 for receiving the DE signal as an input; an AND gate G116 for receiving the output of the inverter I112 and the output of the RS flip-flop 115 as input signals; a second RS flip-flop 113 for receiving a signal outputted from an output terminal OUT of the first decoder 112 as the input of a SET terminal and receiving the output of the inverter I111 as input of a RESET terminal; a third RS flip-flop 114 for receiving the DE signal as the input of a SET terminal and receiving the output of the inverter I111 as the input of a RESET terminal; a second counter 116 for receiving the MCLK signal as an input of the clock terminal CLK and receiving the output of the gate G116 as input of a RST terminal; a second decoder 117 for receiving the output signals A,B,C,D,E, and F of the second counter 116 by using input terminals A,B,C,D,E, and F, respectively; a fourth RS flip-flop 118 for receiving a signal outputted from an output terminal OUT of the second decoder 117 as input of a SET terminal and receiving the DE signal as the input of a RESET terminal; an exclusive OR gate G112 for receiving the signals outputted from an output terminals of the RS flip-flops 113 and 114, respectively; an OR gate G113 for receiving the output signal of the gate G112 and the DE signal as an input; an OR gate G117 for receiving the DE signal and a signal outputted from the output terminal OUT of RS flip-flop 118 as an input; an OR gate G114 for receiving the output of the gates G113 and G117; and an AND gate G115 for receiving both a signal outputted from the gate G114 and a signal outputted from the output terminal OUT of the RS flip-flop 113, and outputting the same signal as the HSYNC signal through a final output terminal OUT.

As shown in FIG. 1, the HSYNC and DE signals are connected to one pin of the DE signal controller 11. If the HSYNC signal is applied to this pin, an output signal of the multiplexer 12 inputting a DE_Mode Sel signal is a high level, and the HSYNC signal inputted at terminal 1 of the multiplexer 12 is outputted to the LCD controller 13 through a terminal OUT of the multiplexer 12. In addition, if the DE signal is applied to this pin, the DE signal is inputted to the DE signal controller 11, an output signal of the multiplexer 12 inputting a DE_Mode Sel signal is a low level, a signal inputted to the input terminal 0 of the multiplexer 12 (namely, the HSYNC signal generated from the DE signal controller 11) is outputted to the LCD controller 13 through the output terminal OUT of the multiplexer 12, and finally the LCD controller 13 outputs a LCD controlling signal after receiving the HSYNC signal. That is, regardless of whether the HSYNC signal on the DE signal is applied to the circuit for outputting a LCD controlling signal while inputting a DE signal, the multiplexer 12 outputs the HSYNC signal continuously.

Figure 3:
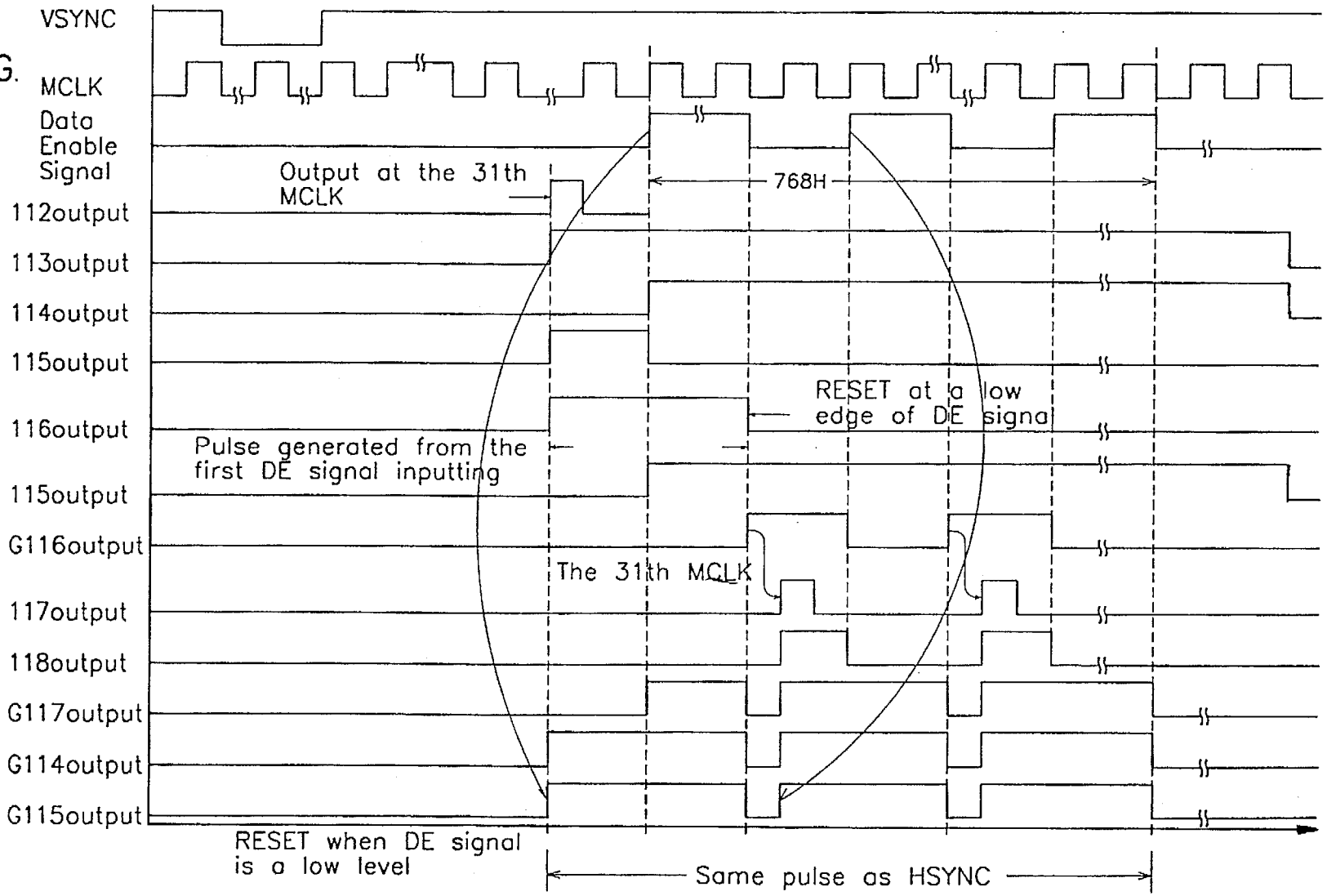
FIG. 3 is a timing diagram for the DE signal controller of a circuit for outputting the LCD controlling signal in inputting the DE signal in accordance with a preferred embodiment of the present invention.

As shown in FIGS. 2 and 3, the first and second counters 111 and 116 count MCLK to 31 times. The decoders 112 and 117 generate a pulse during one clock period of the MCLK at the counted value (0001 1111:Binary code) by 31 times through the 31_CNTS 111 and 116, generate one pulse when the value (0001 1111:Binary code) are respectively inputted to the terminals A,B,C,D,E, and F. In the RS flip-flops 114,114,115, and 118, each terminal OUT maintains a high level when a digital signal 1 is inputted to each SET terminal, and maintains a low level when the digital signal 1 is inputted to each RESET terminal. A VSYNC signal is a vertical synchronization signal for an LCD panel. The DE signal is enabled in a part having an input data. That is, the DE signal is high when the input data exists, and is low when the input data does not exist.

The first counter 111 is reset in inputting the VSYNC signal having a low level, and counts the MCLK after the VSYNC signal converts the low level to a high level. After the first counter 111 counts the MCLK to 31 times, the first decoder 112 outputs only one pulse signal when the 31th clock of the MCLK is generated. This pulse signal, applied to a SET terminal of the RS flip-flop 113, generates a signal shown as 113 output of FIG. 3 when a high level signal that is the VSYNC to be inverted is inputted. The RS flip-flop 114 maintains a high level when the DE signal is inputted, and generates a signal shown as the output of flip-flop 114 in FIG. 3 when the VSYNC signal having a high level is inputted. This signal shown as the output of flip-flop 114 in FIG. 3 is modified together with a signal outputted from the RS flip-flop 113 through the exclusive-OR gate G112, whereby a signal shown as the output of gate G112 in FIG. 3 is outputted. This signal shown as the output of gate G112 in FIG. 3 forms a dummy pulse signal just in front of the clock at which the first DE signal is inputted to the DE signal controller 11, the dummy pulse signal is processed with the DE signal through the OR gate G113. Accordingly, the signal processed by the OR gate G113 is equivalent to the first HSYNC signal using the first DE signal. Next, the present invention provides a signal which is the same as the HSYNC signal by using a first RS flip-flop 115, a gate G116, a second counter 116, a second decoder 117, a fourth RS flip-flop 118, and a gate G117, and performs a logical product operation between the signal outputted from the RS flip-flop 113 and the signal outputted from the gate G114, and outputs a signal shown as the output of gate G115 in FIG. 3. If the output signal of the gate G115, through the multiplexer 12, is connected to the LCD controller 13 which controls the LCD drive IC by using the HSYNC signal, the present invention can obtain the same controlling signal as the controlling signal generated from inputting the HSYNC signal by instead using the DE signal.

Namely, the first counter 111, the first decoder 112, the second RS flip-flop 113, the third RS flip-flop 114, the gate G112, and the gate G113 generate the same as the first HSYNC signal when the first DE signal inputted. The first RS flip-flop 115, the gate G116, the second counter 116, the second decoder 117, the fourth RS flip-flop 118, and the gate G117 continuously generate a signal which is the same as the HSYNC signal until the VSYNC signal is converted to a low level by a second DE signal, which is, until a first frame is finished. The gate G114 performs a logical sum operation for adding both a first output signal and output signals after a second output.

According to a preferred embodiment of the present invention, a circuit for outputting a LCD controlling signal while inputting a DE signal receives DE and HSYNC signals through one pin, makes the HSYNC signal by using the DE signal, and instead of a circuit for controlling an LCD drive IC by a DE signal, it uses a circuit for controlling a LCD drive IC by the HSYNC signal, thereby reducing the number of gates and optimizing the circuit.

What is claimed is:

1. A circuit for controlling an LCD, comprising:

an input terminal which commonly receives a data enable signal and an external HSYNC signal;

a signal controller which receives said data enable signal and which generates an internal HSYNC signal based on said data enable signal, said internal HSYNC signal having substantially the same characteristics as said external HSYNC signal;

a multiplexer which selects and outputs one of said external HSYNC signal and said internal HSYNC signal outputted from said signal controller;

a LCD controller which outputs an LCD controlling signal in accordance with said one of said external and internal HSYNC signals selected by said multiplexer.

2. A circuit as defined in claim 1, wherein said signal controller includes:

a first gate for receiving VSYNC and RST signals;

a first counter for receiving an MCLK signal as input of a clock terminal and receiving an output signal of said gate as input of an RST terminal;

a first decoder for receiving a first counting result of said first counter as an input;

a first inverter for receiving the output of said gate;

a first RS flip-flop for receiving said data enable signal as input of a SET terminal and receiving the output of said first inverter as input of a RESET terminal;

a second inverter for receiving said data enable signal as input;

a second gate for receiving the output of said second inverter and the output of said first RS flip-flop as input signals;

a second RS flip-flop for receiving the output of said first decoder as input of a SET terminal and receiving the output of said first inverter as input of a RESET terminal;

a third RS flip-flop for receiving said data enable signal as input of a SET terminal and receiving the output of said first inverter as input of a RESET terminal;

a second counter for receiving said MCLK signal as input of its clock terminal and receiving the output of said second gate as input of its RST terminal;

a second decoder for receiving a second counting result of said second counter as an input;

a fourth RS flip-flop for receiving the output of said second decoder as input of a SET terminal and receiving the data enable signal as input of a RESET terminal;

a third gate for receiving outputs of said second and third RS flip-flops;

a fourth gate for receiving an output of said third gate and said data enable signal as inputs;

a fifth gate for receiving said data enable signal and the output of said fourth RS flip-flop as inputs;

a sixth gate for receiving outputs of said fourth and fifth gates; and a seventh gate for receiving both the output from said sixth gate and the output of said second RS flip-flop, respectively, and outputting said internal HSYNC signal.

3. The circuit as defined in claim 1, wherein said multiplexer selects and outputs said one of said external and internal HSYNC signals in accordance with a mode select signal such that said LCD controller continuously supplies said LCD controlling signal.

4. A circuit for controlling an LCD, comprising:

an input terminal which commonly receives both an external HSYNC signal and a data enable signal;

a signal controller which receives said data enable signal, a VSYNC signal and a clock signal, and which generates an internal HSYNC signal based on said data enable signal and in accordance with said VSYNC signal and said clock signal, said internal HSYNC signal having substantially the same characteristics as said external HSYNC signal; and a LCD controlling circuit having a multiplexer which selects one of said external HSYNC signal and said internal HSYNC signal and outputs an LCD controlling signal.

5. The circuit as defined in claim 4, wherein said LCD controlling circuit includes:

a LCD controller which outputs said LCD controlling signal in accordance with said one of said external and internal HSYNC signals selected by said multiplexer.

6. The circuit as defined in claim 5, wherein said multiplexer selects and outputs said one of said external and internal HSYNC signals in accordance with a mode select signal such that said LCD controller continuously supplies said LCD controlling signal.

7. A circuit for controlling an LCD, comprising:

a signal controller which receives a data enable signal and which generates an internal HSYNC signal based on said data enable signal, said signal controller including:

a first gate for receiving VSYNC and RST signals;

a first counter for receiving an MCLK signal as input of a clock terminal and receiving an output signal of said gate as input of an RST terminal;

a first decoder for receiving a first counting result of said first counter as an input;

a first inverter for receiving the output of said gate, a first RS flip-flop for receiving said data enable signal as input of a SET terminal and receiving the output of said first inverter as input of a RESET terminal, a second inverter for receiving said data enable signal as input, a second gate for receiving the output of said second inverter and the output of said first RS flip-flop as input signals, a second RS flip-flop for receiving the output of said first decoder as input of a SET terminal and receiving the output of said first inverter as input of a RESET terminal, a third RS flip-flop for receiving said data enable signal as input of a SET terminal and receiving the output of said first inverter as input of a RESET terminal, a second counter for receiving said MCLK signal as input of its clock terminal and receiving the output of said second gate as input of its RST terminal, a second decoder for receiving a second counting result of said second counter as an input, a fourth RS flip-flop for receiving the output of said second decoder as input of a SET terminal and receiving the data enable signal as input of a RESET terminal, a third gate for receiving outputs of said second and third RS flip-flops, a fourth gate for receiving an output of said third gate and said data enable signal as inputs, a fifth gate for receiving said data enable signal and the output of said fourth RS flip-flop as inputs, a sixth gate for receiving outputs of said fourth and fifth gates, and a seventh gate for receiving both the output from said sixth gate and the output of said second RS flip-flop, respectively, and outputting said internal HSYNC signal;

a multiplexer which selects and outputs one of an external HSYNC signal and said internal HSYNC signal outputted from said signal controller; and a LCD controller which outputs an LCD controlling signal in accordance with said one of said external and internal HSYNC signals selected by said multiplexer.

* * * * *